US010297404B1

(12) United States Patent
Ho

(10) Patent No.: US 10,297,404 B1
(45) Date of Patent: May 21, 2019

(54) ILLUMINATED PUSHBUTTION SWITCH

(71) Applicant: LYRIC SHIN ENTERPRISE CO., LTD., Tainan (TW)

(72) Inventor: An-Ching Ho, Tainan (TW)

(73) Assignee: Lyric Shin Enterprise Co., Ltd., Tainan (TW)

( * ) Notice: Subject to any disclaimer, the term of this patent is extended or adjusted under 35 U.S.C. 154(b) by 0 days.

(21) Appl. No.: 15/835,934

(22) Filed: Dec. 8, 2017

(51) Int. Cl.

| | |
|---|---|
| ***H01H 13/02*** | (2006.01) |
| ***H01H 13/06*** | (2006.01) |
| ***H01H 13/14*** | (2006.01) |
| ***H01H 13/50*** | (2006.01) |

(52) U.S. Cl.
CPC ..... *H01H 13/06* (2013.01); *H01H 13/14* (2013.01); *H01H 13/50* (2013.01); *H01H 13/023* (2013.01)

(58) Field of Classification Search
CPC ..... H01H 13/06; H01H 13/14; H01H 13/02; H01H 13/023; H01H 13/063; H01H 13/514; H01H 13/518; H01H 13/50; H01H 13/52
See application file for complete search history.

(56) References Cited

U.S. PATENT DOCUMENTS 6,717,082 B1 * 4/2004 Wu ..... H01H 13/063 200/302.2
9,460,872 B2 * 10/2016 Kirbawy ..... H01H 13/063
9,853,429 B2 * 12/2017 Trolese ..... H05K 5/02

FOREIGN PATENT DOCUMENTS

TW M453947 U1 5/2013

* cited by examiner

*Primary Examiner* — Vanessa Girardi
(74) *Attorney, Agent, or Firm* — Rosenberg, Klein & Lee

(57) ABSTRACT

An illuminated pushbutton switch is provided. The pushbutton switch includes a case, a button assembly received in the case, and a switch contact assembly disposed in the case. The button assembly includes a button part, a first spring against a center of the button part, a waterproof jacket assembled in the button part, and a frame fixed on the button part. The switch contact assembly includes a switch frame, a plurality of second springs against a bottom side of the switch frame, a contact sheet against the plurality of second springs, a rivet penetrating the contact sheet and the switch frame, a plurality of contacts disposed at an interval from the contact sheet, a plurality of pins used for fixing the contacts, and a bottom case receiving the pins.

6 Claims, 5 Drawing Sheets

ILLUMINATED PUSHBUTTION SWITCH

BACKGROUND

Field of Invention

The disclosure relates to a metal button switch. More particularly, the disclosure relates to a metal button switch having contacts and pins with large areas without increasing the volume of the metal button switch, so that the metal button switch can be used to turn on or turn off equipment needs larger current. Therefore, the metal button switch of this invention can be used on ships, factories, or charge machines of general parking lots.

Description of Related Art

Electronic devices have become necessities of modern life, from the most commonly used household appliances in life to the factory's production equipment, vehicles, ships or aircraft and other vehicles, or vending machines seen on the roadside. The actions of these devices have not only been driven by mechanical means nowadays, but also by adding a lot of electronic components to provide richer features, such as automatic production, automatic driving and other functions. Therefore, the current development of electronic equipment is quite diverse. No matter what, there is a great opportunity to link with electronic devices.

The use of electronic equipment needs to consume electricity. In order to decrease the electricity consumed when the electronic devices are not in use, the electronic devices are usually equipped with a switch, and thus users can turn on and off the power supply by themselves. Switches on the market are classified into many types, according to their operation modes, such as toggle switch, rocker switch, or pushbutton switch. Although the operation modes thereof are different, the factions thereof are all used to control the switch of the electronic devices. In terms of button switch, it usually has only one button. A user presses the button to switch the current status of the device. The original ON state will be turned off, and the original OFF state will be turned on. The operation method of the button switch is simple, but the present button switch can be used on small-current electronic devices.

Taiwan Patent No. M453947U1, "waterproof button switch", discloses a common small button switch. For being applied in various environments, a waterproof washer is used to avoid liquid from flowing into the inside of the button switch to damage the inner structure. However, the conductive sheet can be used in smaller rated current devices only. The bearable current of this button switch is about 3-5 A. If a button switch is applied on large vehicles or large-current electronic devices in factories, additional electronic components have to be installed on the circuit of the button switch for controlling the large current by a small current. However, this way will increase the cost or increase the volume of the circuit, and the overall circuit configuration is further affected. In addition, this kind of small button switch, the inner components are not fixed well. Therefore, a poor contact between the contact element and the conductive sheet may occur caused by the shift of the inner components after use for a period of time.

Accordingly, how to improve a general button switch to let a small button switch can be used on high-rated-current electronic devices and the inner components thereof can have a better fixed structure becomes a thinking direction of the inventors.

SUMMARY

In view of the foregoing drawbacks of the present available metal button switch in the real applications, the inventors improve the present available metal button switch by the abundant professional knowledge and the many-year experience to develop this invention.

In one aspect, this invention provides a metal button switch having contacts and pins with large areas. Therefore, the metal button switch not only can be used to control small-current electronic equipment but also can control large-current electronic equipment without additional electronic devices and the problem of volume increase.

Accordingly, a metal button switch is provided. The metal button switch comprises a case, a button assembly received in the case, and a switch contact assembly disposed in the case. The button assembly includes a button part, a first spring against a center of the button part, a waterproof jacket assembled in the button part, and a frame fixed on the button part. The switch contact assembly comprises a switch frame against another end of the first spring, a plurality of second springs against a bottom side of the switch frame, a contact sheet against the plurality of second springs, a rivet penetrating the contact sheet and the switch frame, a plurality of contacts disposed at an interval from the contact sheet, a plurality of pins used for fixing the contacts, and a bottom case receiving the pins.

In one embodiment of this invention, an external side of the case has threads, a hexagonal nut corresponding to the threads, and an O-ring disposed in a slit between the hexagonal nut and the button part.

In another embodiment of this invention, the button part comprises a metal sleeve cover, an upper cover disposed in the metal cover, and a sheet received in the upper cove.

In yet another embodiment of this invention, the button part comprises a metal ring disposed on an inner edge of the case.

In yet another embodiment of this invention, a self-locking hook is optionally disposed on the switch frame.

In yet another embodiment of this invention, a LED assembly is optionally disposed between the button assembly and the switch contact assembly.

In yet another embodiment of this invention, the LED assembly comprises a LED light, a light frame for disposing the LED light, and light pins disposed on two sides of the light frame.

In yet another embodiment of this invention, the light frame is fixed in position above the switch frame, and the first spring surrounds a part of the light frame.

In yet another embodiment of this invention, a jumper board is further disposed in the switch contact assembly through which the pins and the light pins pass.

In yet another embodiment of this invention, the switch frame comprises trenches for correspondingly receiving bumps disposed on inner sides of the frame.

DETAILED DESCRIPTION

Figure 1:
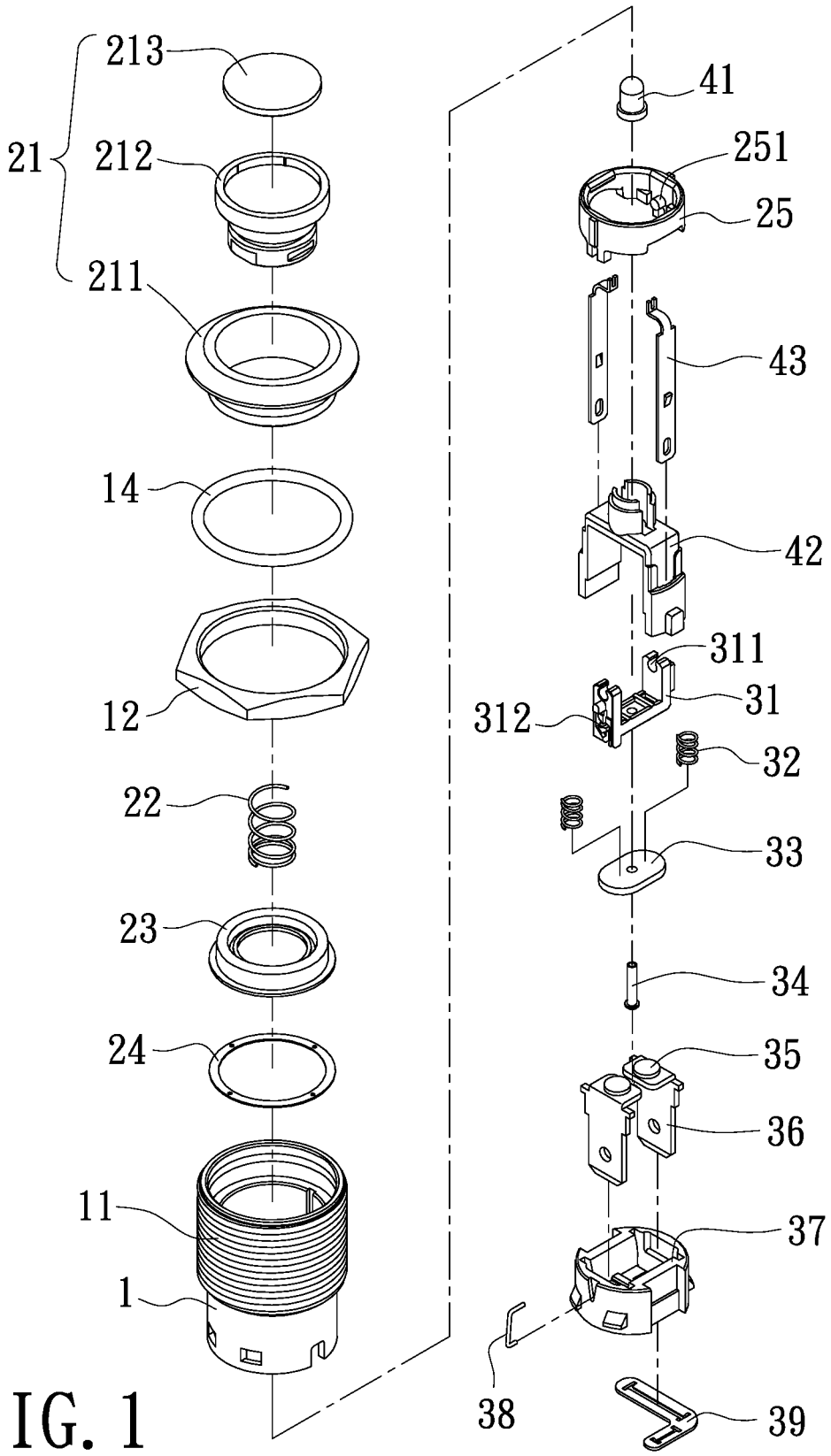
FIG. 1 is an overall decomposition diagram of an embodiment of this invention.
Figure 2:
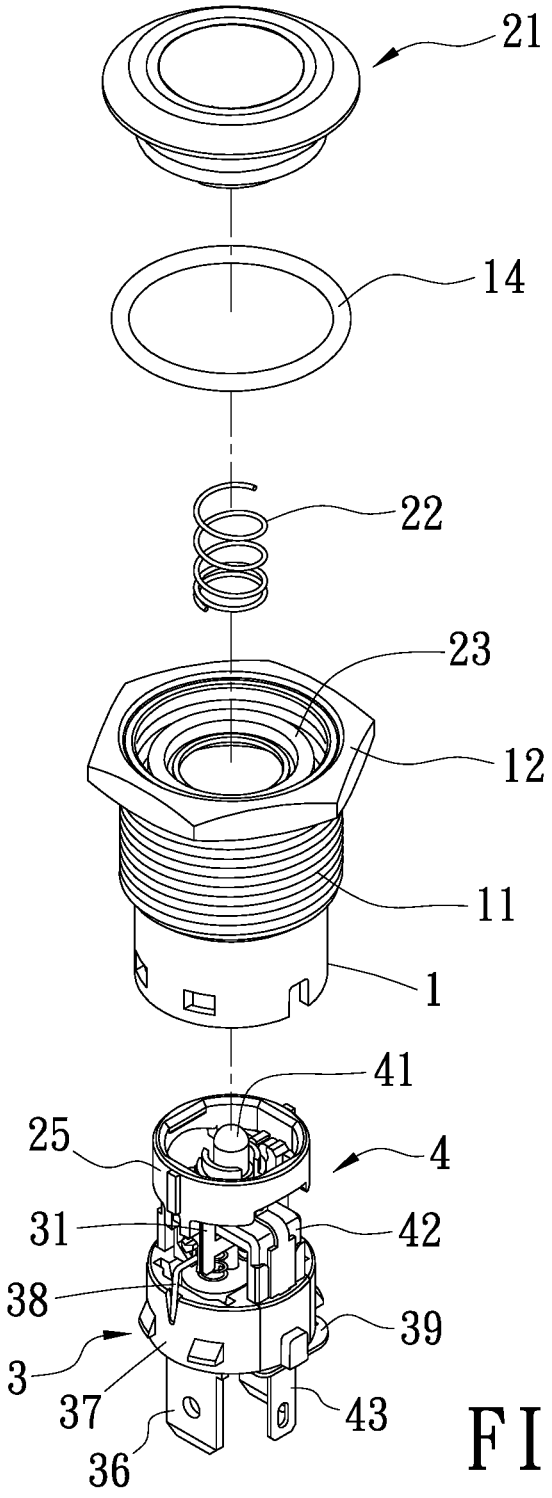
FIG. 2 is a partial decomposition diagram of an embodiment of this invention.
Figure 3:
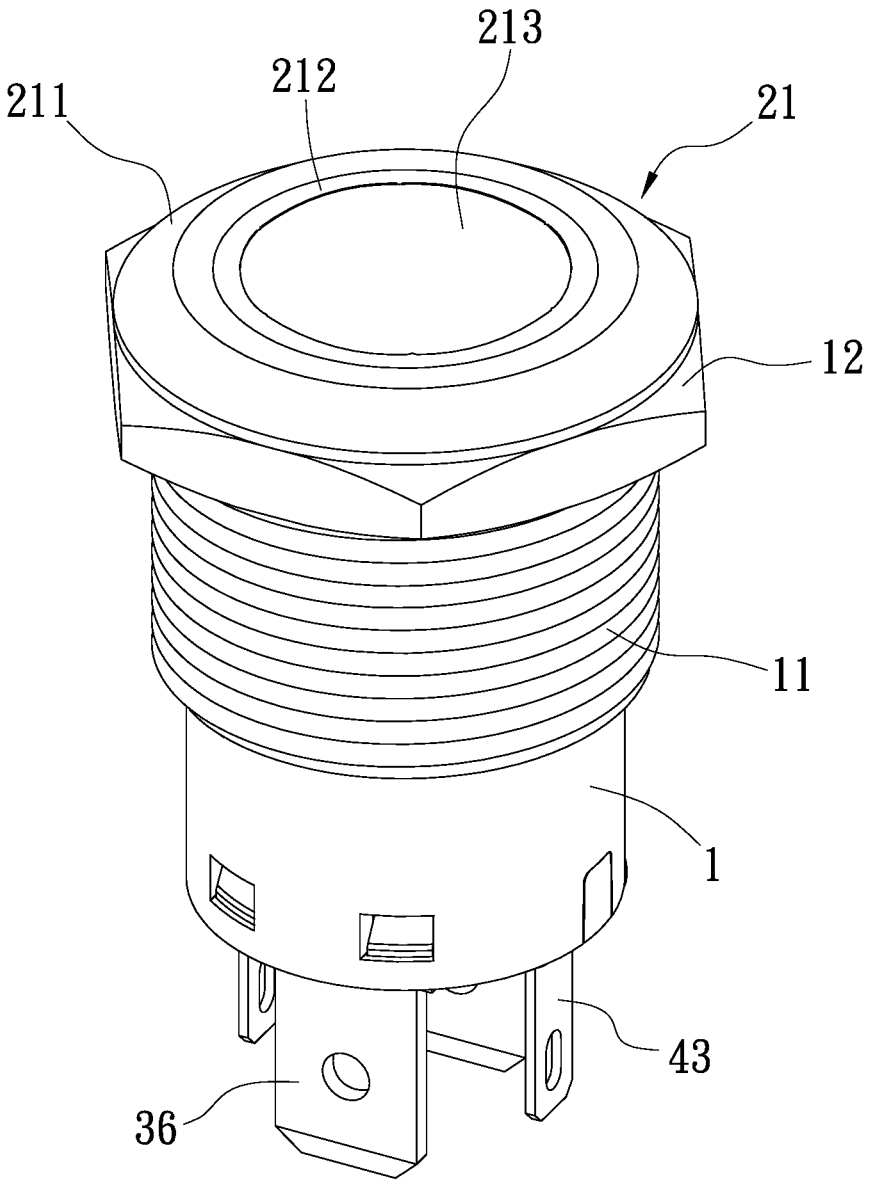
FIG. 3 is an appearance diagram of a button switch according to one embodiment of this invention.

The purposes and advantages of the structural functions of this invention are illustrated according to the structures shown in the figures and embodiments, so that the Examiner can understand this invention more deeply and specifically.

Please refer to FIGS. 1-4. In this invention, a metal button switch comprises a case 1, threads 11 is set on the outer surface of the case 1, and a hexagonal nut 12 is set to correspond to the threads 11. The case 1 can be fixed in a panel of an electronic device.

The metal button switch further comprises a button assembly 2 received in the case 1. The button assembly 2 comprises a button part 21, a first spring 22 against the center of the button part 21, a waterproof jacket 23 assembled in the button part 21, a metal ring 24 disposed on an inner edge 13 of the case 1, and a frame 25 fixed on the button part 21. The waterproof jacket 23 and an O-ring 14 are used to prevent the liquid outside from flowing into the slit of the button part 21. The water is prevented from flowing into the button switch from the slit thereof. In addition, the button part 21 further comprises a metal sleeve cover 211, an upper cover 212 disposed in the metal sleeve cover 211, and a sheet 213. The upper cover 212 is fixed by the frame 25.

The metal button switch further comprises a switch contact assembly 3 disposed in the case 1. The switch contact assembly 3 comprises a switch frame 31, a contact sheet 33 against multiple second springs 32, a rivet 34 penetrating the contact sheet 33 and the switch frame 31, multiple contacts 35 disposed at an interval from the contact sheet 33, multiple pins 36 used for fixing the contacts 35, and a bottom case 37 vertically receiving the pins 36. Trenches 311 of the switch frame 31 are correspondingly disposed to receive bumps 251 disposed on the inner sides of the frame 25, and a self-locking hook 38 is optionally disposed on a hook trench. The self-locking hook 38 can fix or release the switch frame 31, so that the button part 21 can be fixed or rebounded.

A LED assembly 4 may be further disposed between the button assembly 2 and the switch contact assembly 3. The LED assembly 4 comprises a LED light 41, a light frame 42 for disposing the LED light 41, and light pins 43 disposed on two sides of the light frame 42. When the LED assembly 4 is actually installed in the button switch, the first spring 22 will surround a part of the LED light 41. The light frame 42 is disposed against the switch frame 31 and fixed in the bottom case 37. The light pins 43 extend to the bottom case 37 along the outer shape of the lamp frame 42, and are received by the bottom case 37. In addition, a jumper board 39 may be further disposed in the switch contact assembly 3 though which the pins 36 and the light pins 43 pass.

Moreover, the actual applicable range of this invention may be illustrated by the embodiments below, but is not limited thereto in any forms.

Please refer to FIGS. 1-4, in the structure of the metal button switch of this invention, the areas of the contacts 35 and the pins 36 of the switch contact assembly 3 are enlarged. Therefore, the carried current thereof is increased to about 20 A. The case 1 can maintain the original size thereof, although the areas of the contacts 35 and the pins 36 are enlarged. Only the width of the through holes of the bottom case 37 for receiving the pins 36 needs to be enlarged. When the metal button switch is used in a circuit, no other electronic components are needed to assist the control of devices with high rated current.

Figure 4:
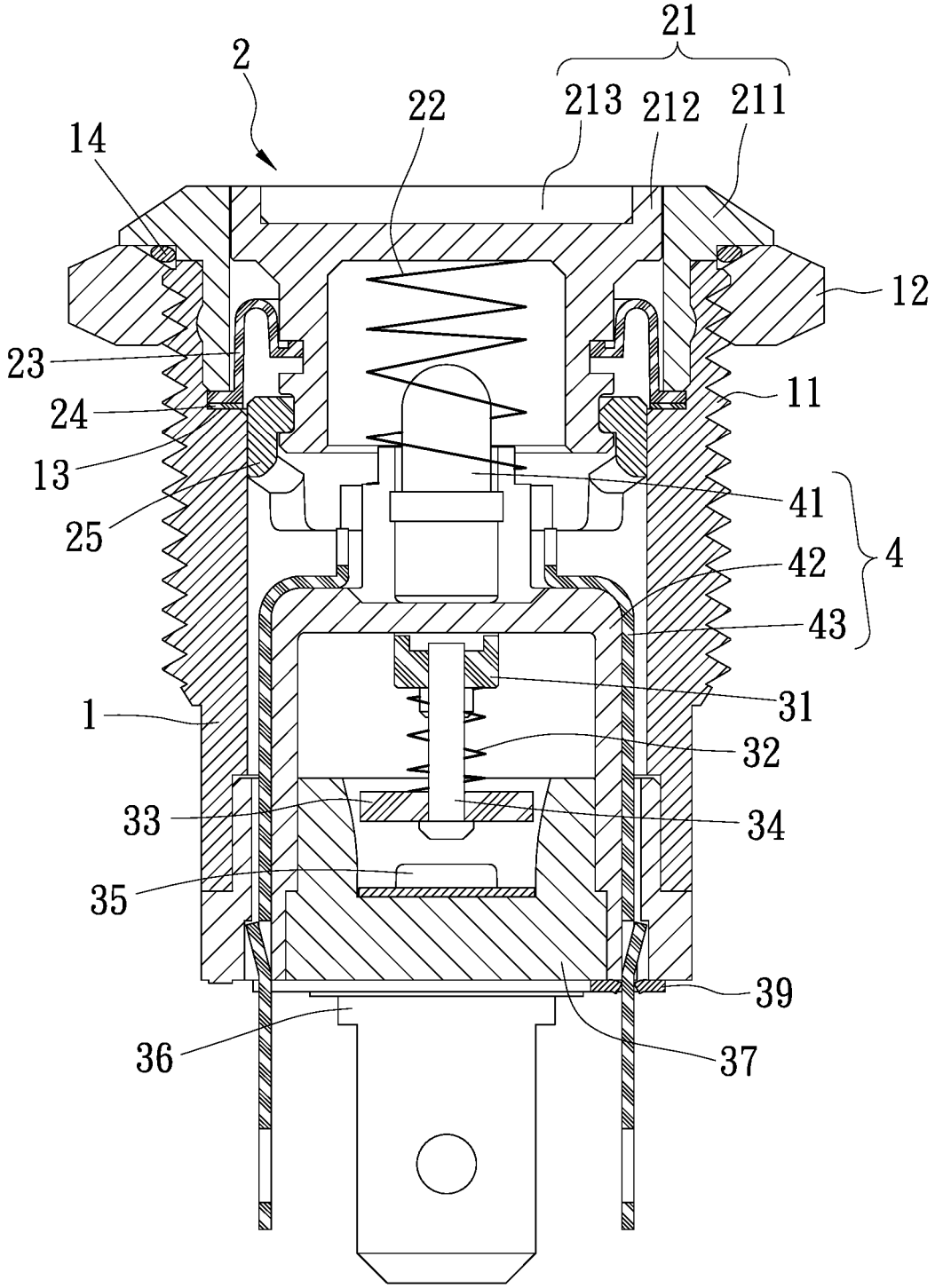
FIG. 4 is a first operation diagram of an embodiment of this invention.
Figure 5:
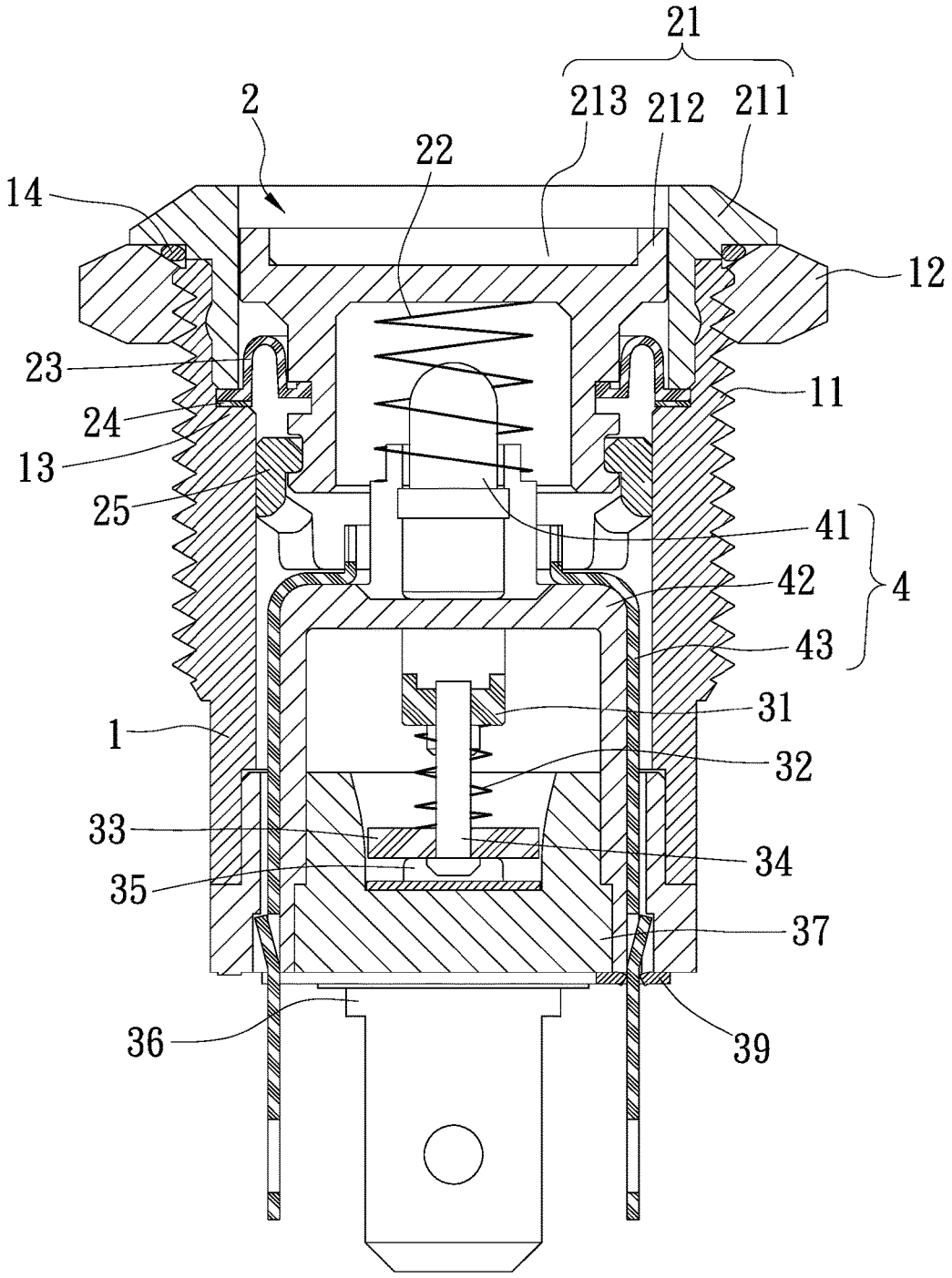
FIG. 5 is a second operation diagram of an embodiment of this invention.

Please refer to FIGS. 4 and 5, which show the actual operation of the metal button switch according to an embodiment of this invention. First, the metal sleeve cover 211, the upper cover 212, and the sheet 213 of the button part 21 are assembled in the case 1. A user may press down the sheet 213. At this time, the sheet 213 and the upper cover 212 will directly push the frame 25 and the first spring 22, and the light frame 42 of the LED assembly 4 will drive the switch frame 31 to move downward after being pushed by the frame 25 and the first spring 22. Since the bumps 251 of the frame 25 are fixed in the trenches 311 of the switch frame 31, the movement of the switch frame 31 is limited in the vertical direction. When the switch frame 31 is downwardly displaced, the self-locking hook 38 is just hung on the hook trench 312 of the switch frame 31 to fix the position of the switch frame 31. Subsequently, the second springs 32 will be pushed by the movement of the switch frame 31, and the contact sheet 33 will be pushed to move by the applied force of the second springs 32. After moving a distance, the contact sheet 33 will touch the contacts 35 disposed on the pins 36, so that the connected electronic device can be operated. Since there are multiple second springs 32, the structural stability of the button switch is increased. Moreover, the heat dissipation effect is increased when the button switch is applied on a large-current device.

If the jumper board 39 and the LED assembly 4 are installed in the switch contact assembly 3, the LED light 41 of the LED assembly 4 will be lighted up when the button part 21 is pressed down. The light of the LED light 41 may shine on the translucent upper cover 212, so that the periphery of the sheet 213 will reveal a circle of light. Therefore, the user can know that the button switch is on, and the electricity is circulated. If no jumper board 39 is connected to the switch contact assembly 3, the LED light 41 will always be illuminated. Hence, the jumper board 39 is optionally installed, according to the choice and need of the user. The light frame 42 of the LED assembly 4 is fixed in position above the switch frame 31, such that the light frame 42 also can limit the movement of the switch frame 31. Hence, the switch frame 31 will not shift left and right in the path of the pressing down of the frame 25.

Furthermore, since the self-licking hook 38 can fix the switch frame 31, the first spring 22 of the button part 21 will not rebound, and the button assembly 2 is kept in the pressed state, as shown in FIG. 5. The pressed state also means that the button switch is turned on. When the user presses again, the self-locking hook 38 will be released from the hook trench of the switch frame 31, and the first spring 22 will rebound to restore the button assembly 2 back to the original state.

According to the illustration of the embodiments, it can be known that this invention has the following advantages, comparing with the prior arts:

1. In this invention, contacts and pins with large areas can be installed in the metal button switch without increasing the volume of the metal button switch. Therefore, the button switch can withstand more current and can be applied on electronic devices with high rated current, from automatic ticket pick-up machine in parking lots to motor equipment on board. Comparing with the prior art, the volume of the cases of the conventional button switches have to be increased if contacts and pins with large areas are to be used.

This invention can avoid the drawbacks of increasing the volume of the conventional button switch or needing additional electronic devices to control the large current resulting in the increased volume of the circuits.

2. In this invention, a waterproof jacket and an O-ring are installed in the metal button switch to block the outside liquid from flowing into the inside of the button switch to damage the inside structure of the button switch. Therefore, the button switch can be used outdoors and is not easily affected by rain or wet environment.

What is claimed is:

1. An illuminated pushbutton switch, comprising:

a case;

a button assembly received in the case, wherein the button assembly includes a button part, a first spring against a center of the button part, a waterproof jacket assembled in the button part, and a frame fixed on the button part;

a switch contact assembly disposed in the case, wherein the switch contact assembly includes a switch frame fixed to the frame, a plurality of second springs against a bottom side of the switch frame, a contact sheet against the plurality of second springs, a rivet penetrating the contact sheet and the switch frame, a plurality of contacts disposed at an interval from the contact sheet, a plurality of pins used for fixing the contacts, and a bottom case receiving the pins; and a LED assembly disposed between the button assembly and the switch contact assembly and having a LED light, a light frame for assembling the LED light, and a pair of light pins electrically connected to the LED light and respectively disposed on two sides of the light frame, wherein the light frame is fixed in position above the switch frame, and the first spring surrounds a part of the light frame.

2. The metal button switch of claim 1, wherein an external side of the case has threads, a hexagonal nut threadedly engages the threads, and an O-ring is disposed in a slit between the hexagonal nut and the button part.

3. The illuminated pushbutton switch of claim 1, wherein the button part includes a metal sleeve cover, an upper cover disposed in the metal sleeve cover, and a sheet received in the upper cover.

4. The illuminated pushbutton switch of claim 1, wherein the button part includes a metal ring disposed on an inner edge of the case.

5. The illuminated pushbutton switch of claim 1, further comprising a jumper board disposed in the switch contact assembly and through which one of the plurality of pins and one of the pair of light pins pass.

6. The illuminated pushbutton switch of claim 1, wherein the frame includes bumps disposed on an inner side thereof and the switch frame includes trenches for correspondingly receiving the bumps therein.

* * * * *